US007529497B2

(12) United States Patent
Hasebe

(10) Patent No.: US 7,529,497 B2
(45) Date of Patent: May 5, 2009

(54) CHARGER, PROCESS UNIT AND IMAGE FORMING APPARATUS

(75) Inventor: Yoshifumi Hasebe, Shizuoka (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 306 days.

(21) Appl. No.: 11/180,694

(22) Filed: Jul. 14, 2005

(65) Prior Publication Data

US 2007/0014587 A1 Jan. 18, 2007

(51) Int. Cl.
*G03G 15/02* (2006.01)

(52) U.S. Cl. ..... 399/100

(58) Field of Classification Search ..... 399/100, 399/168, 170–174, 111; 361/213, 220, 229, 361/230; 250/324–326
See application file for complete search history.

(56) References Cited

U.S. PATENT DOCUMENTS 3,834,814 A * 9/1974 Wolff et al. ..... 355/51
4,924,268 A * 5/1990 Ogura ..... 399/99
5,250,991 A * 10/1993 Ikeda ..... 399/100
5,451,991 A * 9/1995 Saito et al. ..... 347/37
7,167,664 B2 * 1/2007 Nomura et al. ..... 399/167
2005/0025520 A1 * 2/2005 Murakami et al. ..... 399/111

FOREIGN PATENT DOCUMENTS

JP 401142781 A * 6/1989
JP 05281839 A * 10/1993
JP 3202786 B2 6/2001

* cited by examiner

*Primary Examiner*—David M Gray
*Assistant Examiner*—Andrew V Do
(74) *Attorney, Agent, or Firm*—Foley & Lardner LLP

(57) ABSTRACT

According to the present invention, at a position where a cleaning member of a corona discharge member reaches the movement end and a belt with teeth is stopped in driving, a drive pulley slides in contact with a slip area of the belt with teeth, thus although the belt with teeth is stopped in driving, even if a motor is driven, a load applied to the motor is small and the motor can be prevented from faults.

20 Claims, 4 Drawing Sheets

CHARGER, PROCESS UNIT AND IMAGE FORMING APPARATUS

FIELD OF THE INVENTION

The present invention relates to a charger having a cleaning function for a corona discharge member, a process unit and an image forming apparatus which are used for a copier and a printer.

DESCRIPTION OF THE BACKGROUND

In recent years, in an electro-photographic image forming apparatus such as a copier and a printer, to uniformly charge a photosensitive drum or to transfer a toner image and separate sheets of paper, a charger by corona discharge is used. In the charger by corona discharge, when in use, a corona discharge member which is in a wire shape or in a needle shape installed on a metallic plate is contaminated.

When the corona discharge member of the charger is contaminated, uneven charging of the photosensitive drum occurs and the transfer efficiency of a toner image is reduced, thus an image fault is caused or a separation error of sheets of paper occurs. Therefore, conventionally, there is a charger having a cleaning mechanism for cleaning the corona discharge member.

As a cleaning mechanism, a mechanism for attaching a cleaning member to a wire member meshing with a pulley driven by a motor and rotating back and forth and moving back and forth while keeping the cleaning member in contact with the corona discharge member has been developed. The alternating movement of the cleaning member is controlled by controlling the motor by detecting arrival of the cleaning member at either of the ends of the moving range thereof.

In such a cleaning mechanism, during cleaning, it is important that the cleaning member surely moves back and forth overall the total length of the corona discharge member. Further, when the cleaning member stops, it is important that the cleaning member is surely located at either of the ends of the alternating movement.

When the direction of the alternating movement is inverted before the cleaning member reaches either of the ends of the corona discharge member, the whole area of the corona discharge member cannot be cleaned and an uncleaned area is left. Further, when the stop position of the cleaning member is shifted from the ends of the alternating movement, at time of charging, corona discharge by the corona discharge member is interrupted by the cleaning member and normal charging cannot be obtained.

On the other hand, as an image forming apparatus such as a copier or a printer, an image forming apparatus of a tandem type for forming toner images respectively on a plurality of photosensitive drums arranged in parallel, then multiple-transferring the toner images on one sheet of paper, thereby obtaining a color image is known. In such an image forming apparatus of a tandem type, an apparatus for moving back and forth respectively cleaning members of a plurality of corona discharge members arranged in parallel by a common motor is developed.

When driving a plurality of cleaning members by the common motor like this, it is necessary for the cleaning members to move back and forth in synchronization with each other. Therefore, the motor detects arrival of each cleaning member at either of the ends of the alternating movement and then is controlled so as to drive them inversely or stop. Namely, the motor is in the drive state before all the cleaning members reach the ends of the alternating movement.

However, in the aforementioned image forming apparatus of a tandem type, when an optional cleaning member reaches either of the ends of the alternating movement, the belt for supporting the cleaning member is stopped, so that by stop of the pulley meshed with the stopped belt, the motor is locked and an overcurrent flows through the motor and there is a fear that the motor is induced to fail.

Or, when the detection means of the cleaning member fails, although the cleaning member reaches either of the ends of the alternating movement, the motor is not controlled to stop. Therefore, before the error is detected and the motor is stopped, the lock state of the motor due to stop of the pulley is continued and the overcurrent continues to flow and there is a fear that the motor may fail due to the fault of the detection means.

Further, when the drive force of the motor is larger than the load of the belt and after the cleaning member reaches one end of the alternating movement, the pulley continues to rotate, a tooth skip of the belt occurs. Further, in such a case, a load is applied to the motor and there is a fear that the motor is induced to fail.

Therefore, in a charger having a cleaning mechanism, when the cleaning member reaches one end of the alternating movement of the corona discharge member and the belt is stopped, a charger, a process unit and an image forming apparatus for reducing the load of the motor during driving and preventing the motor from damage are desired.

SUMMARY OF THE INVENTION

Therefore, an object of the present invention is to reduce a load applied to a motor of an image forming apparatus having a cleaning mechanism for cleaning a corona discharge member and prevent the motor from damage.

To accomplish the above effect, according to the embodiment of the present invention, the charger includes a corona discharge member, a belt member having an area with teeth and a slip area to move back and forth along the corona discharge member, a cleaning member fixed to the belt member to make contact with the corona discharge member and a belt drive member to make contact with the area with teeth or slip area of the belt member, mesh with the area with teeth and move back and forth the belt member.

DETAILED DESCRIPTION OF THE EMBODIMENTS

Figure 1:
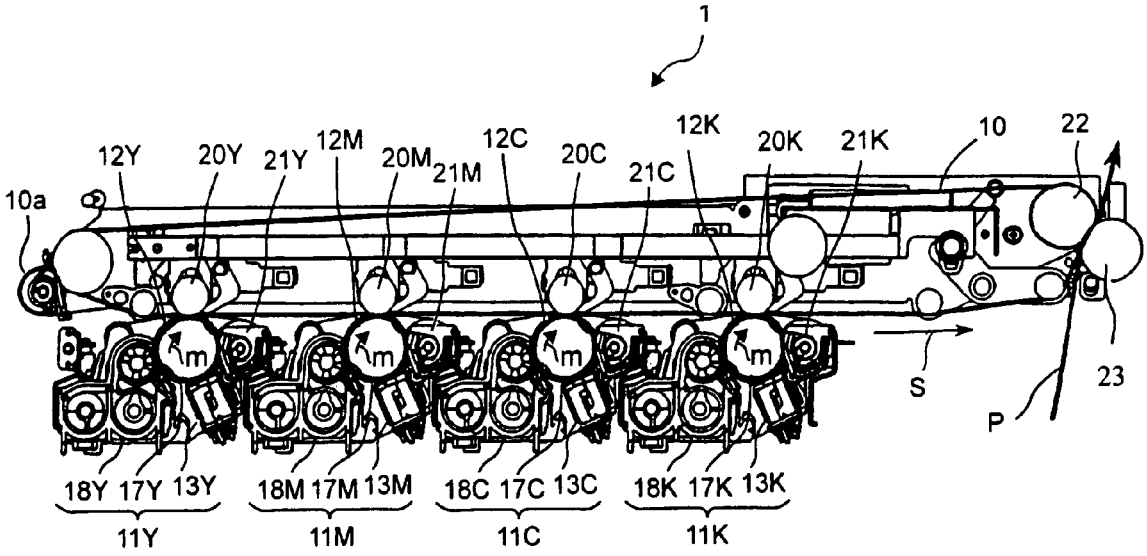
FIG. 1 is a schematic block diagram showing the image forming unit of the color copier of the embodiment of the present invention.
Figure 2:
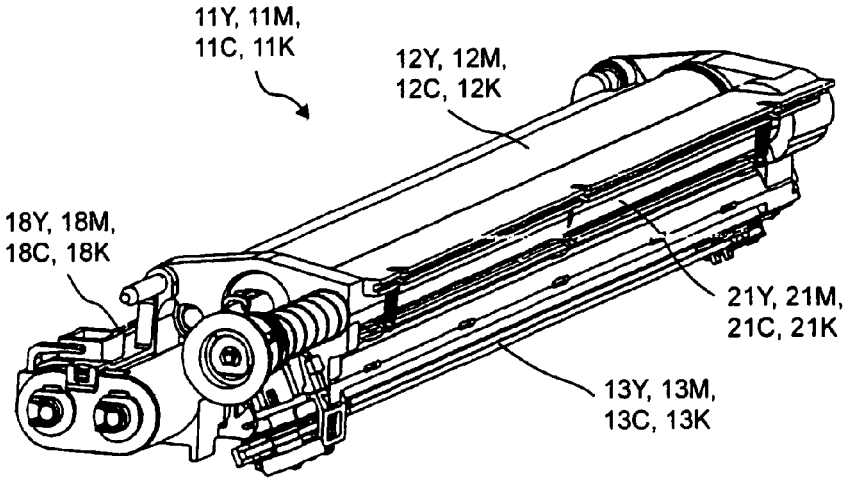
FIG. 2 is a perspective view showing one image forming unit of the embodiment of the present invention.

Hereinafter, the embodiment of the present invention will be explained in detail with reference to the accompanying drawings. FIG. 1 is a schematic block diagram showing image forming unit 1 of the color copier of a 4-each tandem type which is the embodiment of the present invention and an image forming apparatus. Image forming apparatus 1 has image forming units 11Y, 11M, 11C and 11K which are four process units of yellow (Y), magenta (M), cyan (C) and black (K) which are arranged in parallel along the lower side of intermediate transfer belt 10. Image forming units 11Y, 11M, 11C and 11K shown in FIG. 2 can be integrally mounted on and demounted from the image forming apparatus.

Image forming units 11Y, 11M, 11C and 11K respectively have photosensitive drums 12Y, 12M, 12C and 12K which are image carrying members. To the primary transfer positions of intermediate transfer belt 10 which is a transfer member opposite to photosensitive drums 12Y, 12M, 12C and 12K, a primary transfer voltage is applied by primary transfer rollers 20Y, 20M, 20C and 20K and toner images on photosensitive drums 12Y, 12M, 12C and 12K are primarily transferred onto the intermediate transfer belt.

At the secondary transfer position supported by drive roller 22 for stretching and suspending intermediate transfer 10, secondary transfer roller 23 is arranged opposite to it. At the secondary transfer position, a secondary transfer voltage is applied by secondary transfer roller 23 via sheet of paper P and the toner image on intermediate transfer belt 10 is secondarily transferred to sheet of paper P. Primary transfer rollers 20Y, 20M, 20C and 20K and secondary transfer roller 23 constitute a transfer member together with intermediate transfer belt 10. On the downstream side of secondary transfer roller 23 of intermediate transfer belt 10, belt cleaner 10*a* is installed.

In image forming units 11Y, 11M, 11C and 11K, around photosensitive drums 12Y, 12M, 12C and 12K, along the rotational direction in the direction of arrow m, chargers 13Y, 13M, 13C and 13K which are charging members and chargers, exposure positions 17Y, 17M, 17C and 17K by laser beams of various colors irradiated from a laser exposure device (not drawn) which is an exposure member for irradiating exposure light to photosensitive drums 12Y, 12M, 12C and 12K, developing devices 18Y, 18M, 18C and 18K which are developing members and photoconductor cleaners 21Y, 21M, 21C and 21K are arranged.

Figure 3:
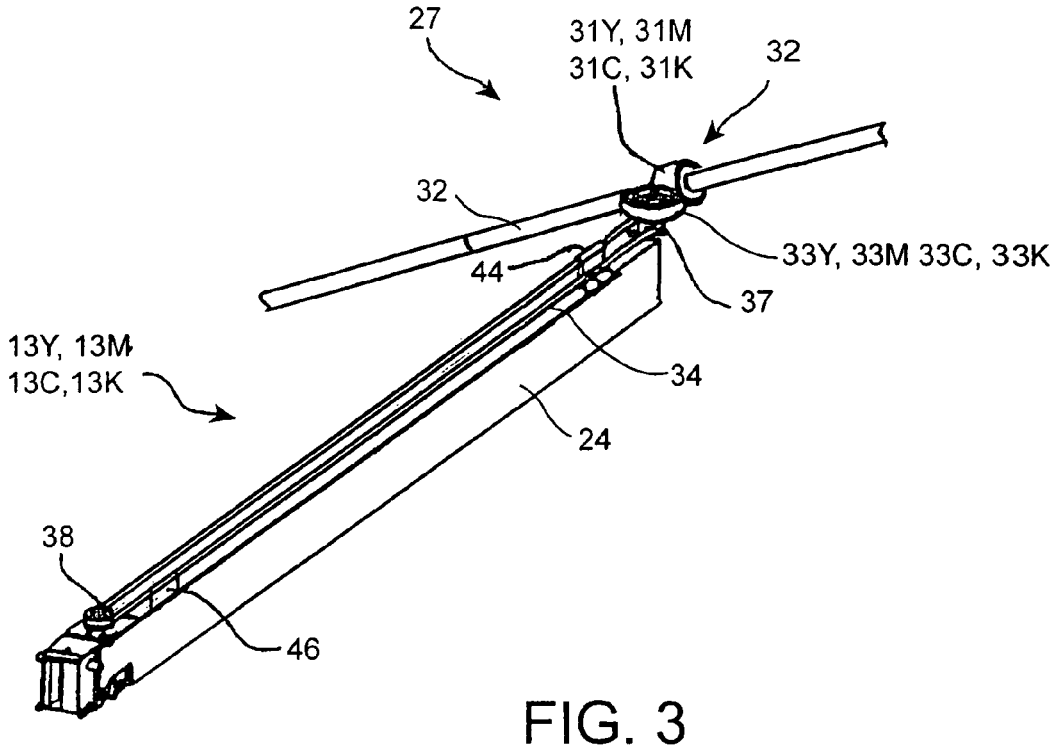
FIG. 3 is a schematic perspective view showing the charger of the embodiment of the present invention.
Figure 4:
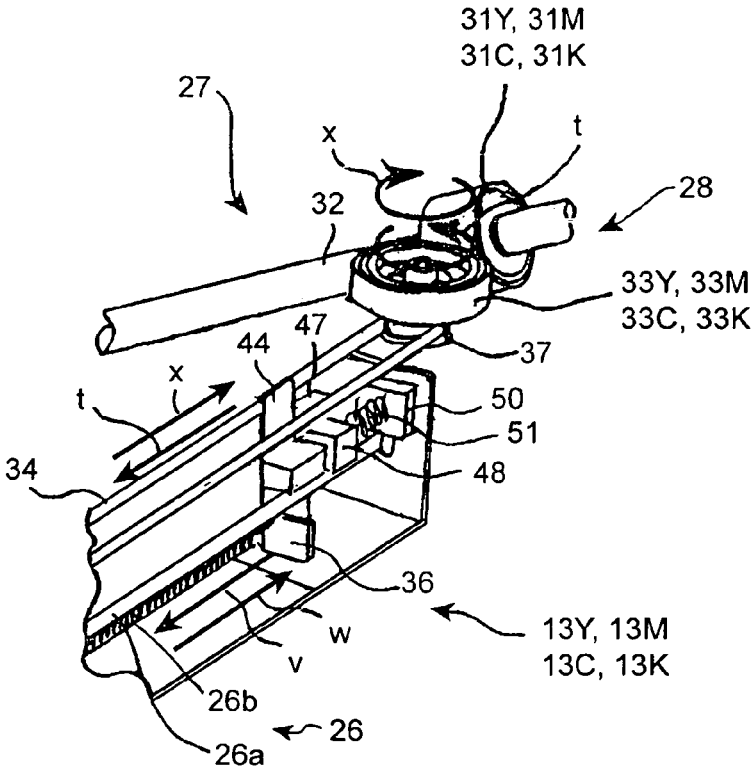
FIG. 4 is a partial perspective view showing the charger cleaner of the embodiment of the present invention.

Next, chargers 13Y, 13M, 13C and 13K will be described in detail. Chargers 13Y, 13M, 13C and 13K have the same structure, so that they will be explained using the common numerals. As shown in FIGS. 3 and 4, chargers 13Y, 13M, 13C and 13K, in charger case 24, have a needle electrode 26 which is a corona discharge member for uniformly charging the overall surface of photosensitive drums 12Y, 12M, 12C and 12K.

Needle electrode 26 is composed of thin metallic plate 26*a* and needle projection 26*b* and the front end of needle projection 26*b* discharges a corona. Further, chargers 13Y, 13M, 13C and 13K have charger cleaner 27 for cleaning an oxide by ozone and soil such as floating toner or paper powder adhered to needle electrode 26.

Figure 5:
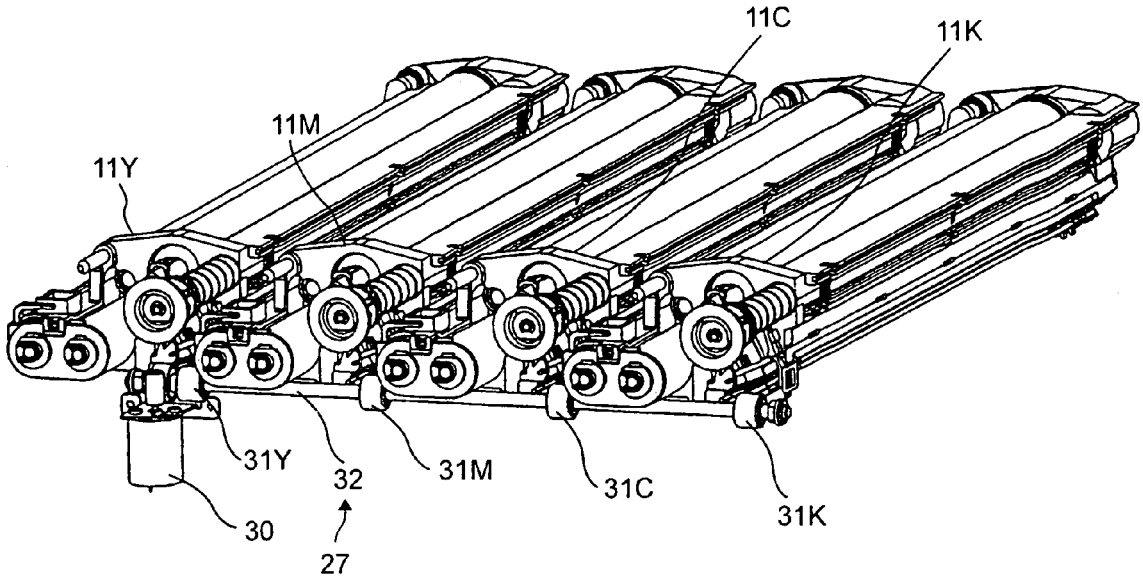
FIG. 5 is a perspective view showing the motor and charger cleaner of the 4-each image forming unit of the embodiment of the present invention.
Figure 6:
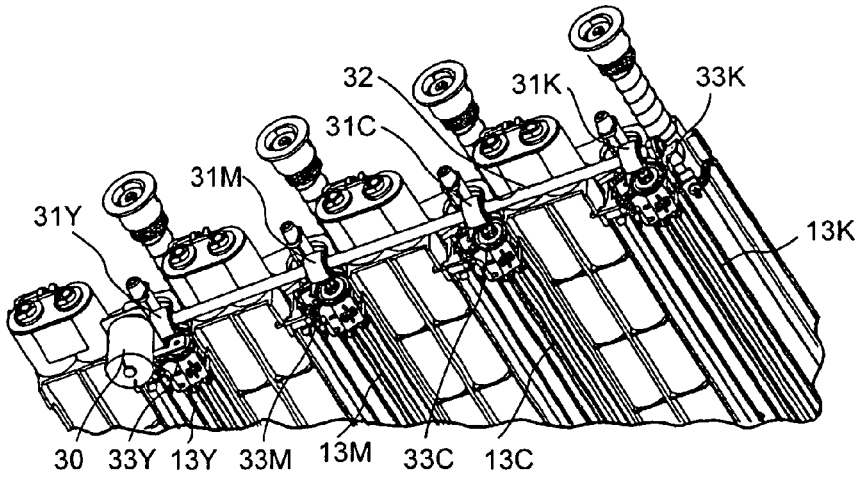
FIG. 6 is a partial perspective view of the motor and charger cleaner of the embodiment of the present invention viewed from underneath.

Charger cleaner 27 rubs the front end of needle projection 26*b* of the needle electrode 26 by cleaning sheet 36 which is a cleaning member to remove soil adhered to needle electrode 26. Charger cleaner 27 has a motor 30 which is a common drive source shown in FIGS. 5 and 6. The drive of motor 30 is transferred to cleaner drive shaft 32 and furthermore to drive pulley 37, which is a belt drive member of chargers 13Y, 13M, 13C and 13K and is coaxial with second cleaner gears 33Y, 33M, 33C and 33K, via second cleaner gears 33Y, 33M, 33C and 33K.

Drive pulley 37 is arranged at one end of charger case 24. At the other end of charger case 24, tension pulley 38 which is a belt stretching member is installed. Between drive pulley 37 and tension pulley 38, belt with teeth 34 which is a belt member is stretched. Cleaning sheet 36 is fixed to belt with teeth 34. Belt with teeth 34 has area with teeth α where teeth are formed as shown in FIGS. 7A, 7B, 8A and 8B and slip area β partially indicated by a dashed line in FIGS. 7A, 7B, 8A and 8B where there are no teeth. Belt with teeth 34, when area with teeth α meshes with drive pulley 37, can rotate back and forth according to rotation of drive pulley 37. Slip area β of belt with teeth 34 can slip on drive pulley 37.

To belt with teeth 34, mounting member 44 for supporting cleaning sheet 36 is fixed. By belt with teeth 34 rotating back and forth according to the forward rotation or backward rotation of motor 30, cleaning sheet 36 moves back and forth while rubbing the front end of needle projection 26*b* of needle electrode 26. Furthermore, at the position symmetrical to the position where mounting member 44 is fixed to belt with teeth 34, pusher 46 is fixed. Pusher 46 is formed similarly to mounting member 44 in a state that it does not have cleaning sheet 36.

Figure 7A:
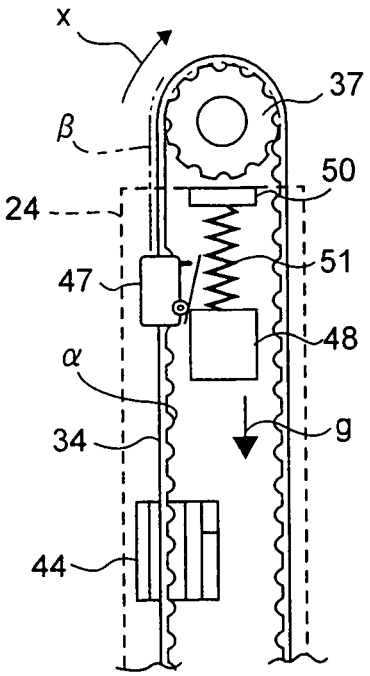
FIG. 7A is a schematic illustration showing a part of the charger cleaner before the cleaning sheet of the embodiment of the present invention reaches the home position.
Figure 7B:
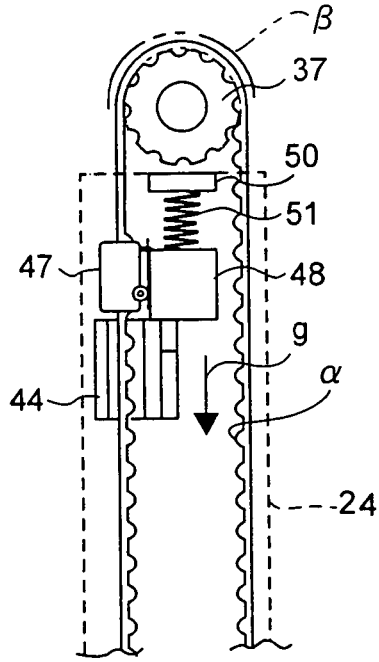
FIG. 7B is a schematic illustration showing a part of the charger cleaner when the cleaning sheet of the embodiment of the present invention reaches the home position.
Figure 8A:
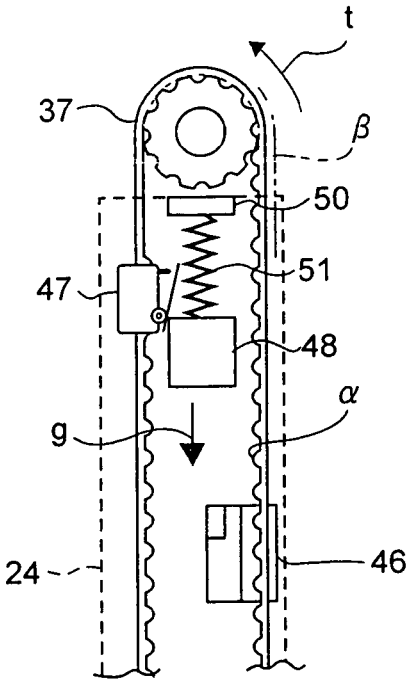
FIG. 8A is a schematic illustration showing a part of the charger cleaner before the cleaning sheet of the embodiment of the present invention reaches the saving position.
Figure 8B:
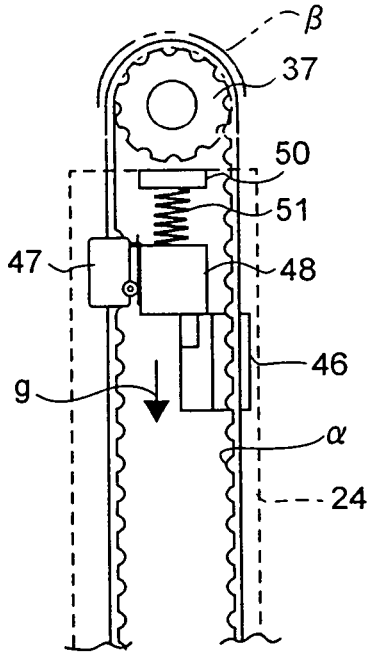
FIG. 8B is a schematic illustration showing a part of the charger cleaner when the cleaning sheet of the embodiment of the present invention reaches the saving position.

Mounting member 44, as shown in FIG. 7B, switches position detection switch 47 for detecting arrival of cleaning sheet 36 at the home position at the end of charger case 24 on the side of drive pulley 37 via slider 48. On the other hand, pusher 46, as shown in FIG. 8B, switches position detection switch 47 via slider 48, thereby detects arrival of cleaning sheet 36 at the saving position at the end of charger case 24 on the side of tension pulley 38. Cleaning sheet 36, when it reaches the home position or saving position, separates from needle electrode 26.

Position detection switch 47 is arranged at the end of charger case 24. Slider 48 for switching position detection switch 47 is always pressed in the direction of arrow g by press-back spring 51 supported by spring holder 50 fixed to charger case 24. Mounting member 44 or pusher 46 reaches the end of charger case 24 and slides slider 48 in the opposite direction to the direction of arrow g against the pressing force of press-back spring 51, thus position detection switch 47 executes switching. Slider 48, at start time of movement of mounting member 44 or pusher 46, presses mounting member 44 or pusher 46 in the direction of arrow g.

Area with teeth α of belt with teeth 34, during alternating movement of cleaning sheet 36, is formed in the position where it is meshed with drive pulley 37. Slip area β of belt with teeth 34, when mounting member 44 reaches the home position at the end of charger case 24 or the saving position and mounting member 44 or pusher 46 makes contact with slider 48 and the rotation of belt with teeth 34 is stopped, is installed in the position where it slides in contact with drive pulley 37.

Next, the operation of the invention will be described. After installation of the image forming apparatus or exchange of any of image forming units 11Y, 11M, 11C and 11K, furthermore after maintenance such as exchange of cleaning sheet 36, the position of cleaning sheet 36 at chargers 13Y, 13M, 13C and 13K is not arranged properly. Therefore, firstly, cleaning sheet 36 at chargers 13Y, 13M, 13C and 13K is set at the home position.

For example, when the copier is switched from the image forming mode to the maintenance mode and image forming units 11Y, 11M, 11C and 11K are exchanged and cleaning sheet 36 is exchanged, an operation of properly arranging cleaning sheet 36 at the home position is started.

When the operation of properly arranging cleaning sheet 36 is started, the position of cleaning sheet 36 at chargers 13Y, 13M, 13C and 13K is unknown, so that all belts with teeth 34 are rotated once in the direction of arrow x for a predetermined period of time. Namely, motor 30 is rotated in the forward direction and first cleaner drive gears 31Y, 31M, 31C and 31K are rotated in synchronization with each other via cleaner drive shaft 32. By doing this, second cleaner drive gears 33Y, 33M, 33C and 33K meshed with first cleaner drive gears 31Y, 31M, 31C and 31K and furthermore drive pulley 37 rotate in the direction of arrow x. Belt with teeth 34 is rotated by drive pulley 37 in the direction of arrow x and mounting member 44 and cleaning sheet 36 supported by it move in the direction of arrow w.

When mounting member 44 switches position detection switch 47 via slider 48, position detection switch 47, from the rotational direction of belt with teeth 34 in the direction of arrow x, recognizes arrival of cleaning sheet 36 at the home position.

Motor 30 is driven, in all chargers 13Y, 13M, 13C and 13K, until cleaning sheet 36 reaches the home position and position detection switch 47 is switched. On the other hand, cleaning sheet 36 reaches the home position and at an optional one of chargers 13Y, 13M, 13C and 13K where mounting member 44 makes contact with slider 48, the rotation of belt with teeth 34 is stopped. However, at this time, slip area β of belt with teeth 34 slides in contact with drive pulley 37. Therefore, drive pulley 37 can continue rotation and motor 30 is not locked.

Hereafter, in all chargers 13Y, 13M, 13C and 13K, cleaning sheets 36 reach the home position and position detection switch 47 is switched, thus motor 30 is stopped. During this period, in the order in which cleaning sheets 36 reach the home position, the rotation of belt with teeth 34 is stopped. However, slip area β of belt with teeth 34 slides in contact with drive pulley 37, so that the load applied to motor 30 is small and motor 30 is not locked.

Further, for example, due to the time lag when controlling motor 30, compared with the timing that cleaning sheet 36 reaches the home position and the rotation of belt with teeth 34 is stopped, even if the timing of controlling stop of motor 30 is delayed by switching of position detection switch 47, slip area βof belt with teeth 34 slides in contact with drive pulley 37, so that drive pulley 37 continues rotation and motor 30 is not locked.

As mentioned above, cleaning sheet 36 is arranged at the home position in all chargers 13Y, 13M, 13C and 13K and then the maintenance mode is canceled and the copier is returned to the image forming mode.

When image forming is started in the image forming mode, image information is input from the scanner or personal computer terminal, thus photosensitive drums 12Y, 12M, 12C and 12K are rotated and in image forming units 11Y, 11M, 11C and 11K, the image forming step is executed sequentially. In yellow (Y) image forming unit 11Y, the surface of photosensitive drum 12Y is uniformly charged by charger 13Y and then is irradiated with a laser beam corresponding to the yellow (Y) image formation at exposure position 17Y and an electrostatic latent image is formed. Furthermore, photosensitive drum 12Y is formed a toner image by developing device 18Y, makes contact with intermediate transfer belt 10 rotating in the direction of arrow S and primarily transfers the toner image onto intermediate transfer belt 10 by primary transfer roller 20Y.

In the same way as with the yellow (Y) toner image forming process, the toner image forming processes of magenta (M), cyan (C) and black (K) are performed. Toner images formed on photosensitive drums 12M, 12C and 12K are transferred sequentially to the same position on intermediate transfer belt 10 as that where the yellow (Y) toner image is formed, then reach the position of secondary transfer roller 23 and are secondarily transferred onto sheet of paper P in a batch. Hereafter, sheet of paper P is subject to the fixing step and the toner images are completed. Intermediate transfer belt 10, after completion of the secondary transfer, is cleaned residual toner by belt cleaner 10*a*. Further, photosensitive drums 12Y, 12M, 12C and 12K, after primarily transferring the toner images onto intermediate transfer belt 10, are removed residual toner by cleaners 21Y, 21M, 21C and 21K and are ready for the next image forming process.

During execution of such image forming processes, soil is adhered to needle electrode 26 of chargers 13Y, 13M, 13C and 13K. When the soil is kept adhered, the discharge becomes non-uniform and uneven charging is caused and the image quality is deteriorated. Therefore, at predetermined timing or when necessary, needle electrode 26 is cleaned by charger cleaner 27.

In the cleaning operation, motor 30 rotates in the forward direction and via cleaner drive shaft 32, first cleaner drive gears 31Y, 31M, 31C and 31K and second cleaner drive gears 33Y, 33M, 33C and 33K meshed with them rotate in synchronization with each other and drive pulley 37 of all chargers 13Y, 13M, 13C and 13K rotate in the direction of arrow t.

Drive pulley 37, at start time of rotation, is in contact with slip area β of belt with teeth 34 and originally in this state, belt with teeth 34 slips on drive pulley 37. However, mounting member 44 is pressed by slider 48 in the direction of arrow g, so that belt with teeth 34, due to the frictional force with drive pulley 37 and the pressing force by slider 48, starts to move in the direction of arrow t without slipping. Next, one tooth of area with teeth α of belt with teeth 34 is meshed with drive pulley 37, thus belt with teeth 34 rotates in the direction of arrow t.

According to the rotation of belt with teeth 34, cleaning sheets 36 supported by mounting member 44 of all chargers 13Y, 13M, 13C and 13K move forward from the home position in the direction of arrow v in synchronization with each other. During forward movement in the direction of arrow v, cleaning sheets 36 rub the front end of needle projection 26*b* of needle electrode 26 and remove soil adhered to needle electrode 26.

During this period, pusher 46 attached to belt with teeth 34 at the position symmetrical with mounting member 44 is moved toward drive pulley 37. When cleaning sheet 36 moving forward in the direction of arrow v reaches the saving position, pusher 46 switches position detection switch 47 via slider 48. Further, pusher 46 makes contact with slider 48, thus the rotation of belt with teeth 34 is stopped. At this time, slip area βof belt with teeth 34 slides in contact with drive pulley 37.

When cleaning sheets 36 of all chargers 13Y, 13M, 13C and 13K moving in synchronization with each other reach the saving position and all pushers 46 switch position detection switch 47 via slider 48, motor 3 is rotated reversely and belt with teeth 34 is moved backward in the direction of arrow x.

Cleaning sheets 36 are moved from the start position in synchronization with each other, so that the timings that all cleaning sheets 36 reach the saving position are the same basically. However, at start time of forward movement, when the timing of arrival of cleaning sheet 36 at the saving position is varied due to a lag of the fitting timing of drive pulley 37 into area with teeth α, any of the pushers 46 makes contact first with slider 48 and the rotation of belt with teeth 34 is stopped. Even if any of belts with teeth 34 is stopped first like this, slip area β of belt with teeth 34 slides in contact with drive pulley 37, so that drive pulley 37 can continue to rotate and motor 30 is not locked.

Further, due to the time lag when controlling motor 30, compared with the rotation stop timing of belt with teeth 34, even if the timing of rotating motor 30 backward is delayed, slip area βof belt with teeth 34 slides in contact with drive pulley 37, so that drive pulley 37 can continue to rotate and motor 30 is not locked.

At start time of backward movement of belt with teeth 34 in the direction of arrow x due to backward rotation of motor 30, drive pulley 37 is in contact with slip area β of belt with teeth 34. However, belt with teeth 34, due to the frictional force with drive pulley 37 and the pressing force for pusher 46 by slider 48 in the direction of arrow g, starts to move in the direction of arrow t without slipping. Next, one tooth of area with teeth α of belt with teeth 34 is meshed with drive pulley 37, thus belt with teeth 34 rotates in the direction of arrow x.

According to the rotation of belt with teeth 34, cleaning sheets 36 supported by mounting member 44 of all chargers 13Y, 13M, 13C and 13K move backward from the saving position in the direction of arrow w in synchronization with each other. During backward movement in the direction of arrow w, cleaning sheets 36 rub the front end of needle projection 26*b* of needle electrode 26 and return to the home position while removing soil adhered to needle electrode 26.

Belts with teeth 34 are moved backward from the saving position in synchronization with each other, so that the timings that all cleaning sheets 36 reach the home position are the same basically. However, even if the timing of arrival of cleaning sheet 36 at the home position is varied and any of the mounting members 44 makes contact first with slider 48, thus any of belts with teeth 34 is stopped first, slip area β of belt with teeth 34 slides in contact with drive pulley 37, so that drive pulley 37 can continue to rotate and motor 30 is not locked.

When position detection switch 47 is switched in all chargers 13Y, 13M, 13C and 13K and detects that all cleaning sheets 36 are returned to the home position, motor 30 stops driving and the cleaning of needle electrode 26 by charger cleaner 27 is completed and chargers 13Y, 13M, 13C and 13K wait for the corona discharge operation. At this time, due to the time lag when controlling motor 30, compared with the rotation stop timing of belt with teeth 34, even if the timing of rotating backward motor 30 is delayed, slip area β of belt with teeth 34 slides in contact with drive pulley 37, so that drive pulley 37 can continue to rotate and motor 30 is not locked.

According to this embodiment, in the color copier of a 4-each tandem type, cleaning member moving devices 28 of chargers 13Y, 13M, 13C and 13K are simultaneously driven by common motor 30, so that there is no need to install a cleaning motor for each of chargers 13Y, 13M, 13C and 13K and the apparatus can be miniaturized and the cost of the apparatus can be decreased.

Further, after end of maintenance, when properly arranging cleaning sheets 36 of chargers 13Y, 13M, 13C and 13K at the home position, if cleaning sheets 36 reach the home position, slip area β of belt with teeth 34 slides in contact with drive pulley 37. Therefore, even if any of belts with teeth 34 is stopped first in the order in which cleaning sheets 36 reach the home position, drive pulley 37 can continue to rotate and motor 30 is not locked. Therefore, faults due to locking of motor 30 can be prevented and all cleaning sheets 36 can be properly arranged at the home position.

Further, even if belt with teeth 34 is stopped before stop of motor 30 due to the time lag of control, when belt with teeth 34 is stopped, slip area β of belt with teeth 34 slides in contact with drive pulley 37. Therefore, drive pulley 37 can continue to rotate and motor 30 is not locked and faults due to locking of motor 30 can be prevented. Further, at time of cleaning, the arrival of cleaning sheets 36 of chargers 13Y, 13M, 13C and 13K at the saving position is varied. Or, even if the return to the home position is varied and any of belts with teeth 34 is stopped first, drive pulley 37 slides in contact with slip area β of belt with teeth 34. Therefore, drive pulley 37 can continue to rotate and motor 30 is not locked and faults due to locking of motor 30 are prevented and all cleaning sheets 36 can be properly arranged at the home position.

Further, at the home position or saving position, the mounting member or pusher is always pressed by slider 48 in the forward movement direction or backward movement direction. Therefore, slipping at start time of forward movement or backward movement can be prevented. Further, the present invention is not limited to this embodiment and within the scope of the present invention, the present invention can be modified variously. For example, the corona discharge member used in the image forming apparatus is not limited to the charger and it may be a transfer charger or a separation charger. Further, the configuration of the corona discharge member is not limited to the needle electrode and may be set optionally, for example, to a wire-shaped discharge member. When the wire-shaped discharge member is used, if a grindstone slides in contact with the discharge member as a cleaning member, soil of the discharge member can be cleaned effectively.

Furthermore, the operation of the charger cleaner by the drive source is not limited and one cleaning operation may be limited to only forward movement or backward movement of the cleaning member. Or, inversely, by one cleaning operation, the cleaning member may be moved back and forth several times.

Further, the image forming apparatus may be monochromatic. Even when charging is executed by a single corona discharge member like a monochromatic image forming apparatus and a single charger cleaner is used, after maintenance of the corona discharge member and charger cleaner, it is necessary to set the cleaning member at the home position. Namely, for example, after maintenance, the motor for driving the charger cleaner continues to rotate for a predetermined period of time so as to return the cleaning member to the home position.

Therefore, depending upon the position of the cleaning member at the beginning of maintenance, the cleaning member reaches the home position considerably before the predetermined time and the belt member is stopped. However, when the belt member is stopped, the drive pulley slides in contact with the slip area, so that the load applied to the motor is small and the motor can be prevented from faults.

Further, the structure of the belt member is not limited and the arrangement of the area with teeth and slip area is not limited. For example, at least overall the total length of the corona discharge member, the area with teeth may be installed only within the range necessary for the alternating movement of the cleaning member and the other part may be used as a slip area. Further, the detection means may be installed on both sides of the belt drive member and belt stretching member.

As described above in detail, according to the present invention, when properly arranging the cleaning member at the home position or when there is a control time lag, the load applied to the drive source can be made smaller and the drive source can be prevented from faults.

Furthermore, when driving the cleaning members of a plurality of corona discharge members by a common drive source, the image forming apparatus can be miniaturized and the cost can be decreased. In such a case, when properly arranging the plurality of cleaning members at the home position, or when there is a control time lag, or when there is a lag in the drive timing of the plurality of cleaning members, the load applied to the drive source can be made smaller and the drive source can be prevented from faults.

What is claimed is:

1. A charger comprising:

a corona discharge member;

a belt member having an area with teeth and a slip area to move back and forth along the corona discharge member;

a cleaning member fixed to the belt member to make contact with the corona discharge member;

a belt drive member to make contact with the area with teeth of the belt member in a meshing state where teeth mesh with the belt drive member or with the slip area of the belt member in a slipping state where the belt member slides with respect to the belt drive member, and move back and forth the belt member; and a position detection switch to detect that the cleaning member is at a position not in contact with the corona discharge member, wherein the slip area of the belt member makes contact with the belt drive member when the cleaning member is at a position not in contact with the corona discharge member, and the area with teeth of the belt member meshes with the belt drive member when the cleaning member is at a position in contact with the corona discharge member.

2. The charger according to claim 1, wherein the position where the cleaning member is not in contact with the corona discharge member is an end of the reciprocating of the cleaning member.

3. The charger according to claim 2, wherein the position detection switch is provided only at one end of the reciprocating of the cleaning member.

4. The charger according to claim 1 further comprising a pressing member to return the area with teeth of the belt member to a meshing state with the belt drive member from a contact state of the slip area of the belt member with the belt drive member.

5. The charger according to claim 1, wherein the belt member is stretched between the belt drive member and a belt stretching member, and the area with teeth is provided only in a contact part with the belt drive member during the reciprocating of the cleaning member.

6. The charger according to claim 1 further comprising a biased sliding member configured to contact and switch the position detection switch.

7. A process unit comprising:

an image carrying member;

a corona discharge member provided in the neighborhood of the image carrying member;

a belt member having an area with teeth and a slip area to move back and forth along the corona discharge member;

a cleaning member fixed to the belt member to make contact with the corona discharge member;

a belt drive member to make contact with the area with teeth of the belt member in a meshing state where teeth mesh with the belt drive member or with the slip area of the belt member in a slipping state where the belt member slides with respect to the belt drive member, and move back and forth the belt member; and a position detection switch to detect that the cleaning member is at a position not in contact with the corona discharge member, wherein the slip area of the belt member makes contact with the belt drive member when the cleaning member is at a position not in contact with the corona discharge member, and the area with teeth of the belt member meshes with the belt drive member when the cleaning member is at a position in contact with the corona discharge member.

8. The process unit according to claim 7, wherein the position where the cleaning member is not in contact with the corona discharge member is an end of the reciprocating of the cleaning member.

9. The process unit according to claim 7, wherein the position detection switch is provided only at one end of the reciprocating of the cleaning member.

10. The process unit according to claim 7 further comprising a pressing member to return the area with teeth of the belt member to a meshing state with the belt drive member from a contact state of the slip area of the belt member with the belt drive member.

11. The process unit according to claim 7, wherein the belt member is stretched between the belt drive member and a belt stretching member, and the area with teeth is provided only in a contact part with the belt drive member during the reciprocating of the cleaning member.

12. An image forming apparatus comprising:

an image carrying member;

a charging member to uniformly charge the image carrying member by a corona discharge member;

an exposure member to irradiate exposure light to the image carrying member uniformly charged by the charging member and form an electrostatic latent image;

a developing member to feed a developer to the electrostatic latent image formed on the image carrying member and form a toner image; and a transfer member to transfer the toner image formed on the image carrying member to a recording medium, wherein the charging member comprising:

a corona discharge member;

a belt member having an area with teeth and a slip area to move back and forth along the corona discharge member;

a cleaning member fixed to the belt member to make contact with the corona discharge member;

a belt drive member to make contact with the area with teeth of the belt member in a meshing state where teeth mesh with the belt drive member or with the slip area of the belt member in a slipping state where the belt member slides with respect to the belt drive member, and move back and forth the belt member; and a position detection switch to detect that the cleaning member is at a position not in contact with the corona discharge member, wherein the slip area of the belt member makes contact with the belt drive member when the cleaning member is at a position not in contact with the corona discharge member, and the area with teeth of the belt member meshes with the belt drive member when the cleaning member is at a position in contact with the corona discharge member.

13. The image forming apparatus according to claim 12, wherein the position where the cleaning member is not in contact with the corona discharge member is an end of the reciprocating of the cleaning member.

14. The image forming apparatus according to claim 12, wherein the detection switch is provided only at one end of the reciprocating of the cleaning member.

15. The image forming apparatus according to claim 12 further comprising a pressing member to return the area with teeth of the belt member to a meshing state with the belt drive member from a contact state of the slip area of the belt member with the belt drive member.

16. The image forming apparatus according to claim 12, wherein the belt member is stretched between the belt drive member and a belt stretching member, and the area with teeth is provided only in a contact part with the belt drive member during the reciprocating of the cleaning member.

17. The image forming apparatus according to claim 12, wherein the image carrying member, the charging member, the exposure member and the developing member constitute an image forming unit and can be integrally mounted and demounted from an apparatus body.

18. The image forming apparatus according to claim 17, wherein a plurality of the image forming units are arranged in parallel in the apparatus body and a plurality of belt drive members of the plurality of image forming units are simultaneously driven by a common drive source.

19. The image forming apparatus according to claim 18, wherein the cleaning member is moved to a home position after the plurality of image forming units are mounted on the apparatus body.

20. The image forming apparatus according to claim 12, wherein the cleaning member moves to a home position after the corona discharge member is mounted on an apparatus body.

* * * * *